United States Patent [19]

Balasty

[11] 4,030,841

[45] June 21, 1977

[54] TRIANGULAR HOLDER AND INSTRUMENT

[76] Inventor: Darrell S. Balasty, 2624 N. McVicker, Chicago, Ill. 60639

[22] Filed: July 24, 1975

[21] Appl. No.: 598,665

[52] U.S. Cl. ..... 401/6; 401/88

[51] Int. Cl.[2] ..... B43K 23/00

[58] Field of Search ..... 401/6, 88, 89, 95, 98, 401/131, 34; 15/443–447

[56] References Cited

UNITED STATES PATENTS

| | | | |
|---|---|---|---|
| 249,893 | 11/1981 | Bulkeley | 401/88 |
| 1,677,387 | 7/1928 | Gaidos | 401/131 |
| 2,173,451 | 9/1939 | Lorber | 401/6 |
| 2,870,740 | 1/1959 | Vogt | 401/88 X |

FOREIGN PATENTS OR APPLICATIONS

| | | | |
|---|---|---|---|
| 406,333 | 1/1910 | France | 401/88 |
| 1,016,159 | 9/1957 | Germany | 401/6 |

*Primary Examiner*—Lawrence Charles

[57] ABSTRACT

A triangular shaped pen or pencil and a triangular shaped device for use in holding a pen or pencil, such as by sliding the device over the length of the writing instrument thereby facilitating the triangular shape of the fingers during the writing exercise.

5 Claims, 9 Drawing Figures

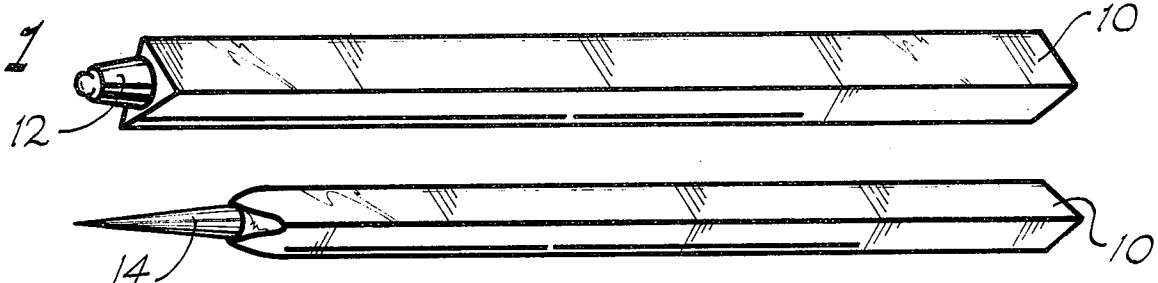
FIG. 1
FIG. 2
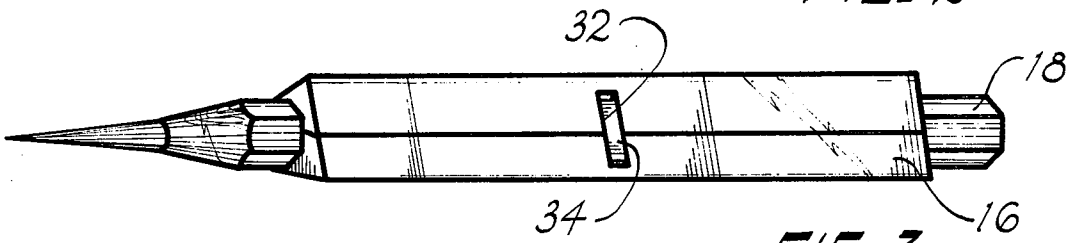
FIG. 3
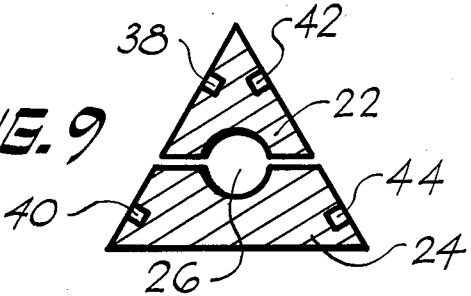
FIG. 9
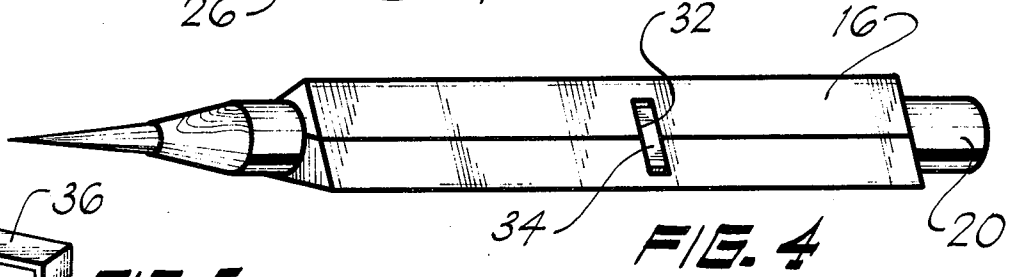
FIG. 4
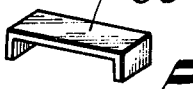
FIG. 5
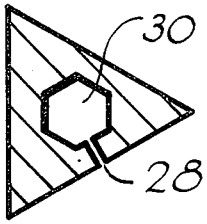
FIG. 6
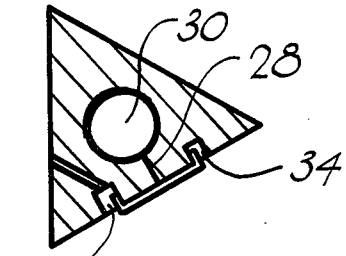
FIG. 7
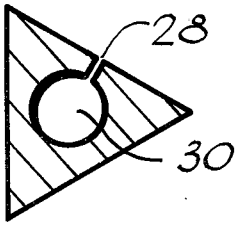
FIG. 8

TRIANGULAR HOLDER AND INSTRUMENT

BACKGROUND OF THE INVENTION

This invention relates to triangular shaped, pens and pencils and to a like shaped elongated, hollow housing for use in conjunction with customarily round or hexagonal shaped writing instruments.

The prior art teaches a variety of shaped writing instruments, but there is not shown a triangular one or a universal device that may be employed in conjunction with most writing instruments to facilitate the triangular shaped configuration of the fingers during the writing exercise thereby alleviating writers cramp and the like.

SUMMARY OF THE INVENTION

It is accordingly an object of the instant invention to provide for a writing instrument and device as aforedescribed.

It is another object to achieve the same at a relatively low cost and at the same time render the device durable and long lasting.

These and other objects of the invention will become more apparent from the following detailed disclosure and claims, and in the accompanying drawings, in which:

FIGS. 1–2 are side elevational views of a triangular shaped writing device such as a pen and pencil, respectively;

FIGS. 3–4 are showing a triangular shaped clip on holder for use in conjunction with a round or hexagonal shaped writing instrument;

FIG. 5 is a side elevational view of a clip for use with the invention; and

FIGS. 6–9 are sectional views of embodiments of the holder shown in FIGS. 3 and 4, respectively.

Broadly speaking, the instant invention includes the provision of a writing instrument holder comprising a substantially elongated walled hollow housing having a triangular outer wall shape open at least at one end and adapted to frictionally engage a writing instrument therein.

A writing instrument comprising a substantially elongated walled hollow housing having a triangular outer wall shape, the housing being open at at least one end, writing means disposed in axial alignment in the housing, the writing means including means projectable from the open end and operative to inscribe characters upon a writing surface.

DETAILED DESCRIPTION

Referring more particularly to the drawings where like elements are designated by like numerals there is shown a substantially triangular shaped ball point writing pen. The pen includes a substantially triangular shaped housing 10 containing a ball point pen writing cartridge 12 therein. The pen may be of the type wherein the writing point is permanently extended or plunger means (not shown) for depressing the writing cartridge may be provided, in the manner customarily employed in the art for the same. FIG. 2 shows a lead pencil having a quantity of lead 14 in the housing 10. The pencil may be fabricated integral in that manner and thereafter sharpened by knive or the housing 10 may contain the mechanical movement of a refillable lead pencil with the lead extending means external the housing 10; the movement will be slidably engaged (frictionally) therein.

Alternatively, the housing 16 may comprise an elongated, hollow shaped member having a triangular outer shaped walls adapted to receive either a hexagonal lead pencil 18 therein or a spherical lead pencil 20. The inner walls are either spherical or hexagonal. The housing 16 is open at at least one end and may be a single unit to frictionally engage the pencil, a two piece triangular member, comprising a triangular outer walled first section 22 adapted to sit on a trapezoidal outer walled second member 24 defining therebetween at the substantially flat point of union an aperture 26 of spherical or hexagonal shape adapted to receive the pencil as shown in FIG. 9, or a single piece triangular outer walled section housing containing a channel 28 in one wall of the triangle communicating with the hollow 30, such as a non-planar side wall section as shown in FIGS. 6–8. For example, the wall will define two angles greater than 90°.

In the embodiment shown in FIGS. 6–9 it is preferable to have two recesses 32, 34, one in each section of the wall separated by the channel 28. A connecting means 36, such as a flat U-shaped clip is operative to have one end thereof engage one recess, respectively, to secure the housing 16 about the pencil or pen 20.

In the embodiment shown in FIG. 9 two clips 36 would be employed, one on each of two sides of the triangular housing, such that one clip would join members 22 and 24 by engaging at recess 38, 40 and a second clip 36 would join members 22, 24 by engaging recesses 42, 44.

In order to facilitate engagement of an oversize instrument 20, housing 16 may be constructed of a resiliant yet durable material that will bend, such as by widening aperture 30, by pulling the side walls such as plastic, rubber or the like or housing 16 may have a resiliant material built into the circumference of the aperture 30.

Since it is obvious that numerous changes and modifications can be made in the above-described details without departing from the spirit and nature of the invention, it is to be understood that all such changes and modifications are included within the scope of the invention.

What I claim is:

1. A writing instrument holder comprising a substantially elongated walled hollow housing having a triangular outer wall shape open at least one end and adapted to frictionally engage a writing instrument therein, one wall of said housing being discontinuous, a slotted aperture communicating between said one wall and the hollow portion of said housing, a pair of recesses in spaced apart relation on said one wall, each recess being on an opposite side of said slotted aperture, a channel communicating between one of said recesses and an opposing wall of said housing, and connecting means adapted to engage said recesses.

2. A holder as defined in claim 1 wherein the inner walls of said housing define a substantially spherical aperture.

3. A holder as defined in claim 1 wherein the inner walls of said housing define a substantially hexagonal shaped aperture.

4. A holder as defined in claim 1 wherein said housing is open at both ends.

5. A holder as defined in claim 1 wherein said connecting means is a substantially flat U shaped member.

* * * * *